US005518300A

United States Patent [19]

Meyer

[11] Patent Number: 5,518,300

[45] Date of Patent: May 21, 1996

[54] METHOD FOR THE MANUFACTURE OF A TOOTHBRUSH

[75] Inventor: Berthold Meyer, Neustadt, Germany

[73] Assignee: M+ Schiffer GmbH, Neustadt, Germany

[21] Appl. No.: 339,036

[22] Filed: Nov. 14, 1994

[30] Foreign Application Priority Data

Nov. 16, 1993 [DE] Germany ..... 43 39 040.4

[51] Int. Cl.[6] ..... A46D 1/08

[52] U.S. Cl. ..... 300/21; 300/4

[58] Field of Search ..... 300/4, 5, 8, 21

[56] References Cited

U.S. PATENT DOCUMENTS 4,958,402 9/1990 Weihrauch ..... 300/21 X
5,061,106 10/1991 Kent ..... 300/21 X
5,165,759 11/1992 Lewis, Jr. ..... 300/21
5,318,352 6/1994 Holland ..... 300/21
5,350,219 9/1994 Shou-Jen ..... 300/21

FOREIGN PATENT DOCUMENTS 0304110 2/1989 European Pat. Off. .

*Primary Examiner*—Timothy V. Eley
*Attorney, Agent, or Firm*—Anderson Kill Olick & Oshinsky

[57] ABSTRACT

A method of manufacturing a tooth brush having a bristle area formed of several folded bristle bundles of plastic bristles, the method including separating, with an anchor, the bristle bundles from a bristle package, folding the bristle bundles and pressing them into dead end holes, which are formed in the bristle area of the toothbrush, with the anchor, with effecting rounding off of the ends of the bristles of the bristle bundles prior to the bristle bundles being folded and anchored in the dead end holes of the tooth brush bristle area.

7 Claims, 1 Drawing Sheet

METHOD FOR THE MANUFACTURE OF A TOOTHBRUSH

BACKGROUND OF THE INVENTION

The invention deals with a method for manufacturing a bristle area of a toothbrush formed by several folded bristle bundles consisting of plastics bristles; the bristle bundles are to begin with individually folded from a bristle package with a predetermined length of the bristles by means of a flat tappet and an anchor and are pressed by said tappet and anchor consecutively into dead end holes of the bristle area of the toothbrush and are solidly anchored therein.

It has been demanded from toothbrushes for some time now for reasons of dental medicine, that, apart from an optimum cleaning of the teeth, said toothbrushes are also to provide a gentle treatment of the gums. Therefore the bristles consisting of plastics material are not permitted to have any sharp edges, fan-outs or the like, at their free user ends, since this would lead to injury of the gums. For this reason the typical feature of a toothbrush of high quality consists in that the user ends of the individual bristles are rounded. This prevents injury to the gums and the aimed-for massaging effects of the rounded bristle ends is fully effective on the gums.

The rounding of the utilization ends of the bristles is preferably performed by a type of grinding process, wherein it is always to be assured, that all bristles of a bundle or the entire bristle area are rounded off uniformly. In a toothbrush where the individual bristle bundles are folded and are respectively secured by means of an anchor in the bristle field of the toothbrush, the bristle bundles having a greater length are to begin with cut to the same size and only then are the free bristle ends rounded-off. In another type of manufacture of a bristle field, where the individual bristle bundles are severed from an endless bristle strand, the individual bristles of a bristle bundle are already rounded at the utilization ends prior to their insertion into the toothbrush.

From the aspect of dental medicine one aims these days for the individual bristle bundles and/or the individual bristles in the bristle bundle to have a different length. This is meant to increase the cleaning effect in particular in the critical spaces between the teeth and to improve the effect of the massage. Herein high-/low cuts, which can extend longitudinally or laterally, wave-shaped cuts, V-shaped cuts and saw-shaped cuts are known. This differing length of the bristles can be achieved without any difficulty by a process where the individual bristle bundles are cut out of an endless bristle strand, are rounded on the utilization side and then, possibly after fusing of the attachment ends together are inserted or poured into a toothbrush.

In a method for the manufacture of a toothbrush, where the bristle bundles are to begin with separated individually out of a bristle package with predetermined length of the bristles, then are folded with the help of an anchor, are thereupon pressed and anchored consecutively by means of the anchor into the dead end holes of the bristle area of a toothbrush, this results in an impairment of the rounded off-shape. As is known in this method, the utilization side bristle ends of the bristles are rounded-off in one single work step after being cut-off. If this cut now does not run in one single plane, only the longer bristles of a bristle bundle or of the bristle area are rounded-off optimally. The bristle ends located lower are either inadequately or not at all swept by the processing tool, so that the lower lying bristle ends can still have sharp edges, fan-outs or the like. This means that with this fabrication process using the profiled cut when cutting the bristles or bristle bundles of a bristle field to size, the aimed-for quality of a high quality toothbrush cannot be achieved meaning the individual bristle ends are not optimally rounded-off. Herein it must also be taken into account, that dust accumulates in the course of the rounding-off process of the bristle ends of a bristle field of a toothbrush, which dust can attach itself in the bristle area and thus can no longer be completely removed, even with great effort.

Therefore the invention is based upon the task of providing a method for fabrication of a bristle area of a tooth brush, formed of a plurality of folded bristle bundles made from plastics bristles, where, even with conventional manufacture of the bristle area, meaning individualization or isolation, folding and attachment of the bristle bundle by means of an anchor, in a profiling of the bristle area with different bristle lengths, an optimum rounding-off of the bristle ends is feasible. In addition to this it is to be prevented that the dust accumulating when rounding-off the bristles can reach the toothbrush.

SUMMARY OF THE INVENTION

For solving the task of the invention, a method of the previously described type is proposed, where the bristles are rounded-off at both ends already prior to their folding and anchoring.

This means that the bristles are rounded-off no longer after formation of the bristle area of the toothbrush but already before that. This enables to achieve an optimum rounding of all bristle ends of a bristle area also in the course of such a fabrication process of a toothbrush when profiling the utilization surface of the bristle area. The dust generated in the course of the rounding-off process can thus no longer reach the toothbrush. According to the invention the bristles of each bristle bundle are rounded off together, e.g., in a bristle setting machine during the travel of the bristle bundle up to its insertion into an appropriate dead end hole. Also, the bristles of an entire bristle package can be rounded together.

Further, during insertion of the bristle bundles at least a portion of the bundles can be folded off center, e.g., above and below center, so that a bristle area is stuffed with several bristle bundles, having different type of folding.

BRIEF DESCRIPTION OF THE DRAWINGS

In the following the invention is described with particularity with the help of the embodiment examples shown in a drawing. Herein it is shown on.

DETAILED DESCRIPTION OF PREFERRED EMBODIMENTS

Figure 1:
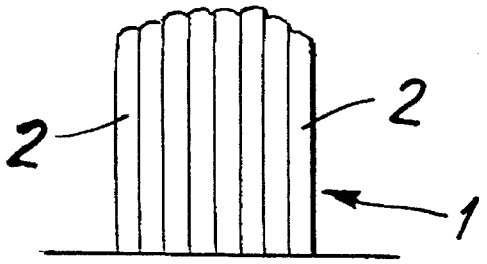
FIG. 1 the end region of a bristle bundle formed by folding and already inserted into a toothbrush, and FIG. 2 the end region of six bristle bundles inserted into one plane of a toothbrush and also fabricated by folding.

The free end region of a bristle bundle 1 is shown in FIG. 1 of the drawing, which bundle consists of a plurality of bristles 2 from plastics material. Herein, in order to achieve a better clarity of the bristle bundle 1, only eight bristles 2 are shown at a considerably larger scale.

The bristle bundle 1 was now fabricated in a manner known as such in a way, that bundles with the same quantity of bristles 2 were isolated or individualized consecutively from a bristle package, wherein the quantity of the bristles 2 in this bundle is precisely half of the bristles 2 in the finished bundle 1. The lengths of the individual bristles 2 of the bristle package correspond to a precisely predetermined length. In addition all bristles 2 of the bristle package are rounded-off in an optimum manner at both their ends, wherein this rounding-off is selectively performed either by the manufacturer of the bristle package or when processing the bristle packages. This rounding-off of the ends of the bristles 2 can herein occur either in the entire bristle package or on individual bristle bundles. It is advantageous if the bristles of a bristle bundle are rounded off when same travels from the separation out of the bristle package to the appropriate dead end hole.

The isolated bristle bundles are then subsequently folded by means of an anchor consisting of metal, so that the finished bundles 1 are formed. These finished bundles 1 are then pressed or stuffed into dead end holes in the bristle area of the toothbrush, wherein the respective bristle bundle 1 is tightly secured by the metal anchor in the respective dead end hole. Thus conventional bristle securing machines can be used for fabrication of the bristle area of the toothbrush.

Due to folding the bristles or the separated bundles into the bristle bundle 1, the ends of the bristles 2 are necessarily not located in one single plane, as this can be seen particularly well in FIG. 1. The deviation of the individual bristle ends from an imagined plane can herein amount to between 0.5 and 2 mm. The differently long bristles 2 of the bristle bundle 1 result already in the aimed-for improved massage of the gums and a better cleaning, in particular of the intermediate spaces between the teeth. The longer bristles 2 are able to penetrate into the intermediate spaces between the teeth already at a slight contact pressure while the shorter bristles 2 clean only the surface of the teeth.

Figure 2:
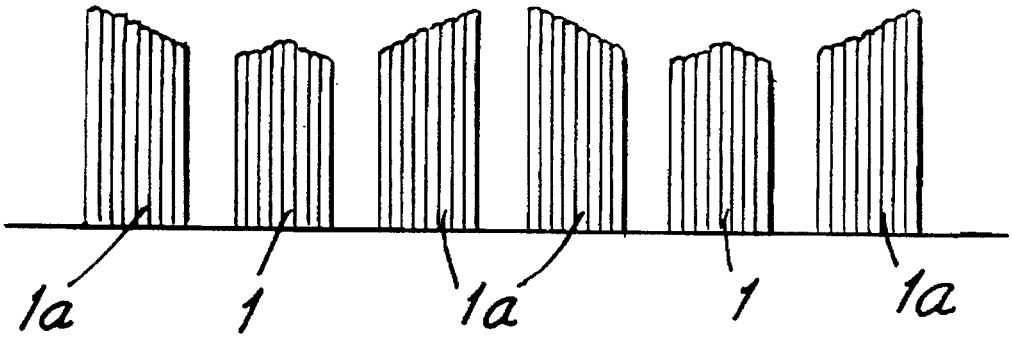

A profiling of the bristle area or of the individual bristle bundles 1 is also possible when this type of fabrication is used, as this is shown in FIG. 2. Herein FIG. 2 shows six bristle bundles 1, 1*a* preferably located consecutively in one single plane, which when extracted corresponds to the longitudinal section through the bristle area of a toothbrush. The respectively two inner shorter bristle bundles 1 correspond herein to the bristle bundle 1 in FIG. 1, where it is intended that the ends of all bristles 2 are located in one single plane if at all possible. The two outer and the two middle bristle bundles 1*a*, which originated from another bristle package having a greater bristle length have a contour of the individual bristles 2 which rises outwardly or inwardly. This contour can be achieved in a simple manner in that, the individual bristle bundles produced by individualization forming the bristle bundles 1*a* are folded, so that several bristles are located slightly off center. This type of folding occurs as a function of the position of the bristle bundle 1*a* in the bristle area either above or below the center of the bristle bundle 1*a*. Herein also the ends of the individual bristles 2 can deviate by a dimension of approximately 0.5 to 2 mm from a predetermined plane or a predetermined profile, which can be desirable for the aimed-at massage- and cleaning effect.

I claim:

1. In a method of manufacturing a tooth brush having a bristle area formed of several folded bristle bundles of plastic bristles, said method including separating, with an anchor, the bristle bundles from a bristle package with a predetermined bristle length, folding the bristle bundles and pressing same into dead end holes, which are formed in the bristle area of the toothbrush, with the anchor, and rounding off of ends of bristles of the bristle bundles, an improvement comprising rounding the bristle ends at both ends of the bristle bundles prior to the bristle bundles being folded and anchored in the dead end holes of the toothbrush bristle area.

2. In the method of claim 1, an improvement comprising rounding off of the bristle ends of each bristle bundle together.

3. In the method of claim 2, an improvement comprising rounding off of the bristle ends of each bristle bundles in a bristle setting machine during travel of the bristle bundle up to an insertion of same into a respective dead end hole.

4. In the method of claim 1, an improvement comprising rounding off of the bristle ends of the entire bristle package.

5. In the method of claim 1, an improvement comprising folding of at least a portion of the bristle bundles off a center of bristle bundles of the portion of the bristle bundles.

6. In the method of claim 5, an improvement comprising folding of the portion of the bristle bundles above and below the center.

7. In the method of claim 1, an improvement comprising separating the bristle bundles from two bristle packages having different bristle length, respectively.

* * * * *